US009542825B2

(12) United States Patent
Sun

(10) Patent No.: US 9,542,825 B2
(45) Date of Patent: Jan. 10, 2017

(54) DETECTION SYSTEM FOR COLD CHAIN TRANSPORTATION DEVICE

(71) Applicant: HON HAI PRECISION INDUSTRY CO., LTD., New Taipei (TW)

(72) Inventor: Zong-Yuan Sun, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/590,355

(22) Filed: Jan. 6, 2015

(65) Prior Publication Data

US 2016/0063842 A1 Mar. 3, 2016

(30) Foreign Application Priority Data

Aug. 28, 2014 (CN) ..... 2014 1 0428760

(51) Int. Cl.
*G08B 19/00* (2006.01)
*G08B 21/18* (2006.01)
*G08B 13/12* (2006.01)

(52) U.S. Cl.
CPC ..... *G08B 21/182* (2013.01); *G08B 13/126* (2013.01)

(58) Field of Classification Search
CPC ..... A01N 1/00; G08B 21/182
USPC ..... 340/521
See application file for complete search history.

(56) References Cited

U.S. PATENT DOCUMENTS

2010/0306544 A1* 12/2010 Lionetti ..... H04L 9/083 713/171
2013/0278067 A1* 10/2013 Poss ..... B65F 1/0033 307/62
2014/0266791 A1* 9/2014 Lloyd ..... H04Q 9/00 340/870.09
2014/0317005 A1* 10/2014 Balwani ..... G06Q 10/0832 705/317
2015/0017627 A1* 1/2015 Anderson ..... C12M 45/22 435/1.2

* cited by examiner

*Primary Examiner* — Don N Vo
(74) *Attorney, Agent, or Firm* — Zhigang Ma

(57) ABSTRACT

A cold chain transportation device includes a body, a cover, and a detection system. The cover is coupled to the body. The detection system includes a control unit, a temperature sensor, and a detection unit. The temperature sensor senses a temperature of the cold chain transportation device. The detection unit detects opened/closed states of cover. The control unit determines motion states and working states of the cold chain transportation device and transmits the temperature, the opened/closed states, the motion states, and the working states of the cold chain transportation device to an electronic terminal.

16 Claims, 4 Drawing Sheets

DETECTION SYSTEM FOR COLD CHAIN TRANSPORTATION DEVICE

FIELD

The subject matter herein generally relates to transportation systems, and particularly to a cold chain transportation device with a temperature detection function.

BACKGROUND

To facilitate and extend the shelf life of products, such as, for example, chemicals, foods, and pharmaceutical drugs, from manufacture through distribution, a temperature-controlled supply chain (sometimes referred to as a cold chain) is generally required. An unbroken cold chain, for example, generally includes an uninterrupted series of storage and distribution activities, which consistently maintain a product's environment within a desired, relatively low, temperature range. Consequently, packaging used in the cold chain must often maintain a product's environment within the desired, relatively low, temperature range for an extended period of time, thereby ensuring that the product's temperature stays within a proper temperature range for the entire duration of the cold chain transmission, from manufacture to end use.

BRIEF DESCRIPTION OF THE DRAWINGS

Implementations of the present technology will now be described, by way of example only, with reference to the attached figures.

DETAILED DESCRIPTION

Figure 1:
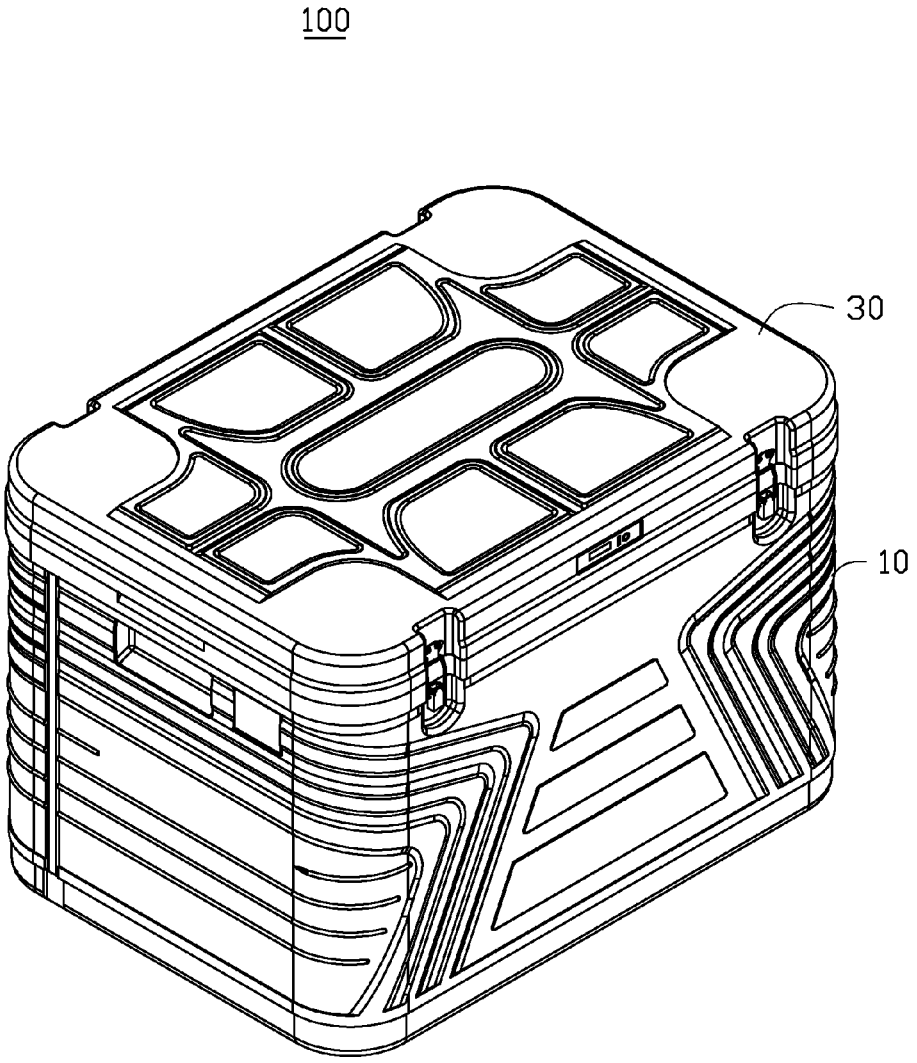
FIG. 1 is an assembled, isometric view of a cold chain transportation device, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a detection system for a cold chain transportation device.

Figure 2:
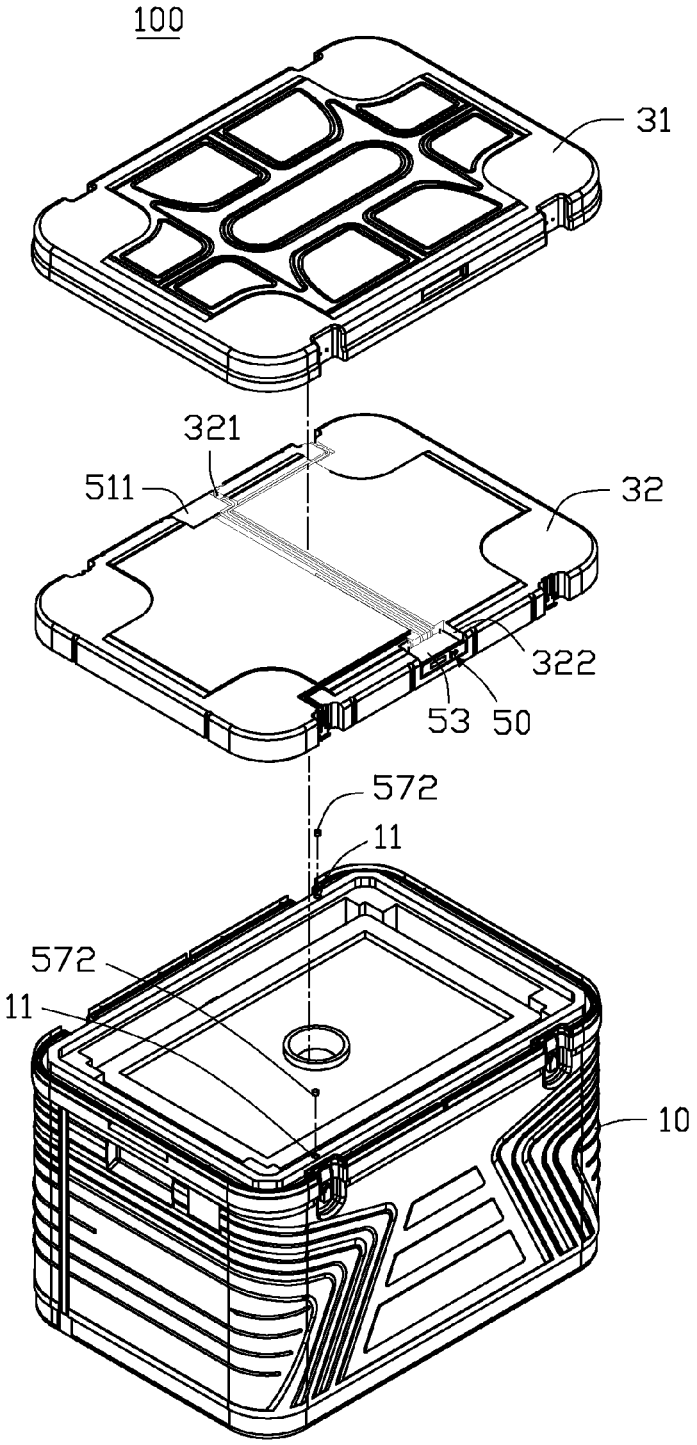
FIG. 2 is an exploded, isometric view of the cold chain transportation device of FIG. 1.

FIGS. 1 and 2 illustrate an embodiment of a cold chain transportation device 100, according to an exemplary embodiment. The cold chain transportation device 100 includes a body 10, a cover 30, and a detection system 50.

The body 10 can be a carton, a box and/or any other sealing hollow containers suitable for containing an item, such as chemicals, foods, and pharmaceutical drugs, for example. The body 10 may be made from various materials, including, for example, recycled paper, plastic and/or a wood material. In addition, the body 10 defines two holes 11 at a boundary frame.

The cover 30 is mounted to, e.g. hinged to, the body 10 to cover the body 10. In at least one embodiment, the cover 30 includes an outer shell 31 and a plate 32. The outer shell 31 is mounted to the body 10, and the plate 32 engages with the body 10. Additionally, the plate 32 is received in the outer shell 31 and defines a first receiving groove 321 and a second receiving groove 322.

Figure 4:
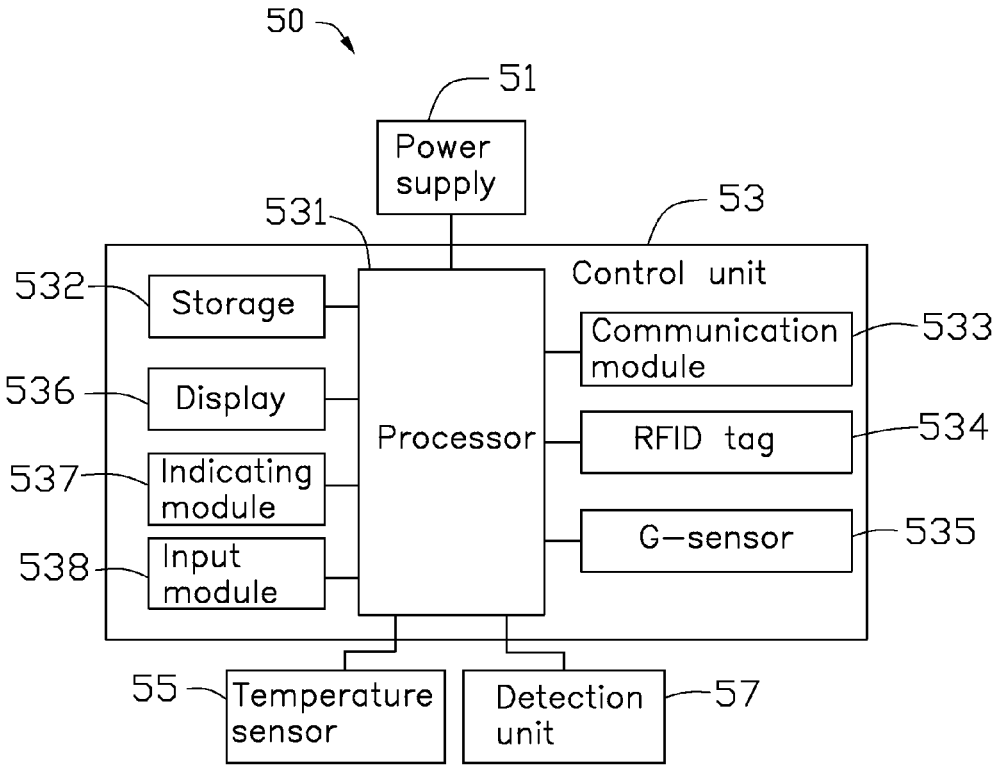
FIG. 4 is a block diagram of a detection system employed in the cold chain transportation device of FIG. 1.

FIG. 4 illustrates the detection system 50 including a power supply 51, a control unit 53, a temperature sensor 55, and a detection unit 57. The power supply 51 is received in the first receiving groove 321 to power the control unit 53, the temperature sensor 55, and the detection unit 57. The temperature sensor 55 is configured to sense a temperature of the cold chain transportation device 100. The detection unit 57 is configured to detect whether the cover 30 is closed or opened relative to the body 10. The control unit 53 is received in the second receiving groove 322 and is configured to determine motion states and working states of the cold chain transportation device 100, details of these feature will be illustrated below.

Figure 3:
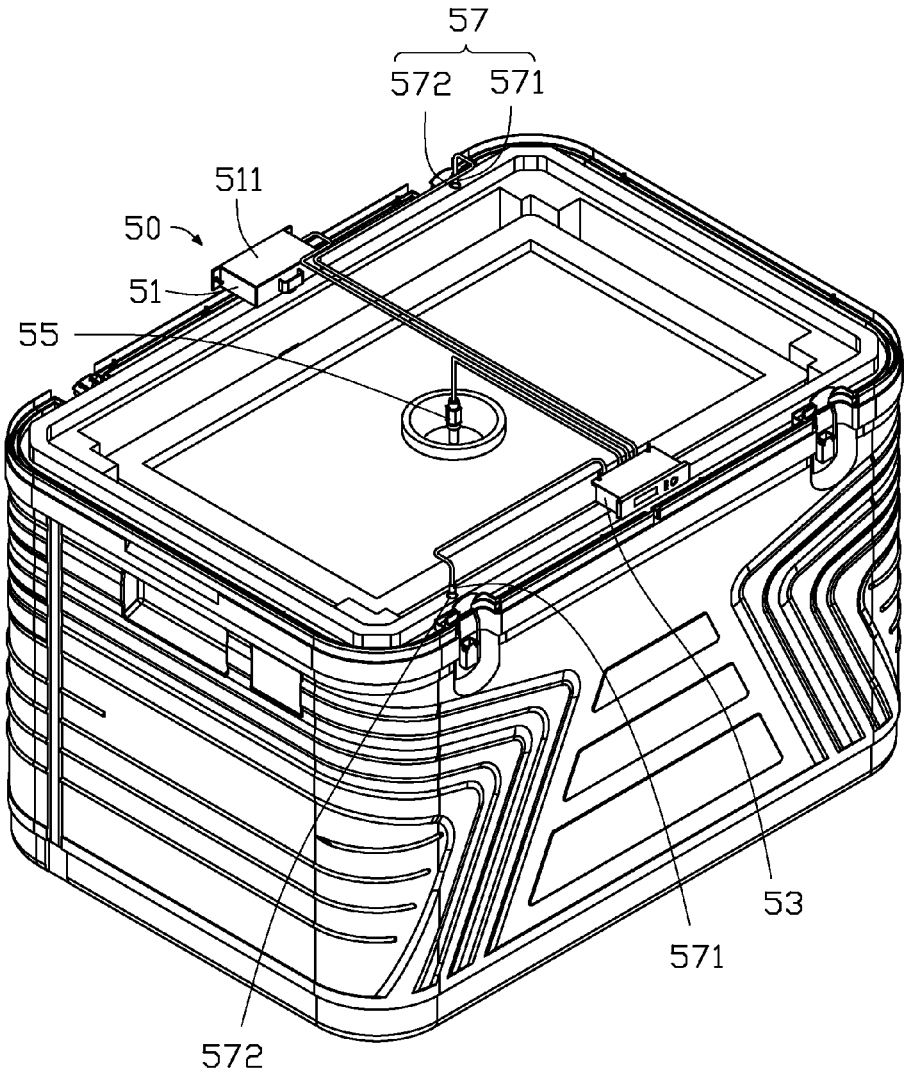
FIG. 3 is a partially assembled, isometric view of the cold chain transportation device of FIG. 1.

FIG. 3 illustrates the power supply 51 including a cell box 511 and at least one battery accommodated in the cell box 511. In at least one embodiment, the at least one battery can be a rechargeable battery with capacity of about 2200 mAh.

The control unit 53 includes a processor 531, a storage 532, a communication module 533, a radio frequency identification (RFID) tag 534, a gravity sensor (G-sensor) 535, a display 536, an indicating module 537, and an input module 538. The processor 531 is electronically connected to the storage 532, the communication module 533, the RFID tag 534, the G-sensor 535, the display 536, the indicating module 537, and the input module 538.

The storage 532 is configured to store the opened/closed states of the cover 30, the temperature, the motion states, and the working states of the cold chain transportation device 100.

The communication module 533 can be a general packet radio service (GPRS) unit. The communication module 533 is configured to transmit data of the temperature, the opened/closed states, the motion states, and the working states of the cold chain transportation device 100 to an electronic terminal at a fixed time interval. The electronic terminal can be a tablet, a personal computer, or a mobile phone. In at least one embodiment, the motion states include an inclined angle and an acceleration of the cold chain transportation device 100. The working states include working modes of the detection system 50 and a remaining capacity of the power supply 51. Additionally, the communication module 533 transmits a positioning signal to the electronic terminal based on a mobile positioning service system and receives a setting command or a short message from the electronic terminal. Thus, a system clock, a temperature threshold, an inclined threshold, an acceleration threshold, a first remaining capacity threshold, a second remaining capacity threshold, and other parameters (such as time of turning on/off, sleeping, or restarting) of the detection system 50 can be set or reset by the setting command or the short message. Optionally, the parameters at least including the temperature threshold, the inclined threshold, and the acceleration threshold can be also stored in the storage 532.

The RFID tag 534 is configured to allocate an identification number to the cold chain transportation device 100 for allowing the electronic terminal to identify the cold chain transportation device 100. In at least one embodiment, the RFID tag 534 operates at 2.4 GHz, and a transmitting power and a transmitting frequency of the RFID tag 534 can be adjusted.

The G-sensor 535 is configured to detect the inclined angle and the acceleration of the cold chain transportation device 100, and then the G-sensor 535 transmits the inclined angle and the acceleration to the processors 531. The processor 531 compares the inclined angle and the acceleration with the inclined threshold and the acceleration threshold, respectively. If the inclined angle of the cold chain transportation device 100 exceeds the inclined threshold or the acceleration of the cold chain transportation device 100 exceeds the acceleration threshold, the processor 531 triggers a control signal to enable the indicating module 537. In at least one embodiment, the inclined threshold can be about 30 degrees, and the acceleration threshold can be about 1 g.

The display 536 is configured to display the temperature of the cold chain transportation device 100, the remaining capacity of the power supply 51, and the working modes of the detection system 50. In addition, a flight mode icon and a wireless communication icon can be shown on display 536 for indicating the working modes of the detection system 50.

In at least one embodiment, the working modes of the detection system 50 include a non flight mode, a flight delay mode, and a flight mode. In detail, when the detection system 50 works at the non flight mode, the wireless communication icon can be highlighted and shown on the display 536. At this time, all the functions of the detection system 50 can be activated. When the detection system 50 works at the flight delay mode, the flight mode icon can be highlighted and shown on the display 536. At this time, all the functions of the detection system 50 can also be activated. After a predetermined time, the detection system 50 may enter the flight mode from the flight delay mode. At this time, the communication module 533 and the RFID tag 534 are disabled, other functions of the detection system 50 can be still activated. In at least one embodiment, the predetermined time can be about three hours. The detection system 50 can exit the flight mode by manually manipulating the input module 538, or by the setting command or the short message. In at least one embodiment, the detection system 50 enters the non flight mode by default once being powered on.

The indicating module 537 includes a buzzer and a plurality of light emitting diodes (LEDs). The LEDs include a first LED, a second LED, a third LED, and a fourth LED. When the temperature of the cold chain transportation device 100 exceeds the temperature threshold, the processor 531 turns on the first LED and the buzzer. When the inclined angle of the cold chain transportation device 100 exceeds the inclined threshold or the acceleration of the cold chain transportation device 100 exceeds the acceleration threshold, the processor 531 turns on the second LED and the buzzer. When the remaining capacity of the power supply 51 is less than the first remaining capacity threshold, the processor 531 turns on the third LED. When he remaining capacity of the power supply 51 is less than the second remaining capacity threshold, the processor 531 turns on the fourth LED and turns off the communication module 533 to conserve power. In at least one embodiment, the second remaining capacity threshold is less than the first remaining capacity threshold.

In at least one embodiment, the input module 538 includes at least one key. The detection system 50 can be set or reset by pressing the input module 538. In detail, for example, the detection system 50 can be powered on/off by pressing the input module 538 two times for a predetermined period of time, such as three seconds, and the display 536 can be activated by clicking the input module 538. For another example, the working modes of the detection system 50 can be set or mutually switched by pressing the input module 538.

The temperature sensor 55 is coupled to the processor 531 via a signal wire to transmit the temperature of the cold chain transportation device 100 to the processor 531. In at least one embodiment, a temperature sensing range of the temperature sensor 55 can be about −55 degrees to +125 degrees, a resolution of the temperature sensor 55 can be about 0.1 degrees, and an error of the temperature sensor 55 can be about ±0.5 degrees.

Referring to FIG. 3, the detection unit 57 includes two magnetic switches 571 and two magnets 572. The two magnets 572 are respectively received in the two holes 11 of the body 10. In at least one embodiment, both the two magnetic switches 571 can be a Hall switch which is coupled to the processor 531, and the two magnetic switches 571 are positioned at the plate 32 and are respectively in close proximity to the two magnets 572. Thus, when the cover 30 is opened, the two magnetic switches 571 are actuated in response to magnetic fields of the two magnets 572 to output a first signal indicating of the opened state of the cover 30 to the processor 531. At this time, the temperature, the opened/closed states, the motion states, and the working states of the cold chain transportation device 100 can be immediately and continuously stored in the storage 532 and be transmitted by the communication module 533. When the cover 30 is closed, the two magnetic switches 571 are actuated by magnetic fields of the two magnets 572 to output a second signal indicating of the closed state of the cover 30 to the processor 531. At this time, the temperature, the opened/closed states, the motion states, and the working states of the cold chain transportation device 100 can be stored and transmitted at the fixed time interval. Specifically, the detection system 50 cannot enter the flight mode when the cover 30 is opened.

In summary, the temperature sensor 55 senses the temperature of the cold chain transportation device 100, the detection unit 57 detects the opened/closed states of the cover 30, and the control unit 53 determines the motion states and the working states of the cold chain transportation device 100. Then, the communication module 533 transmits the temperature, the opened/closed states, the motion states, and the working states of the cold chain transportation device 100 to the electronic terminal to facilitate remote monitoring. Additionally, the processor 531 may trigger the control signal to enable the indicating module 537 according to the temperature, the inclined angle, and the acceleration. Thus, it is sufficient to efficiently ensure that the items stays within a proper condition for the entire duration of the cold chain transmission, from manufacture to end use. Therefore, the cold chain transportation device 100 is both intelligent and convenient.

The embodiments shown and described above are only examples. Many details are often found in the art such as the other features of the case and the cold chain transportation device using the same. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A cold chain transportation device comprising:

a body;

a cover coupled to the body; and a detection system comprising a control unit, a temperature sensor, and a detection unit, the temperature sensor sensing a temperature of the cold chain transportation device, the detection unit detecting opened/closed states of cover, and the control unit determining motion states and working states of the cold chain transportation device and transmitting the temperature, the opened/closed states, the motion states, and the working states of the cold chain transportation device to an electronic terminal, the motion states comprising an inclined angle and an acceleration of the cold chain transportation device.

2. The cold chain transportation device as claimed in claim 1, wherein the control unit comprises a processor and a gravity sensor (G-sensor), the inclined angle and the acceleration of the cold chain transportation device is detected by the G-sensor, the processor compares the inclined angle and the acceleration with an inclined threshold and an acceleration threshold, respectively.

3. The cold chain transportation device as claimed in claim 2, wherein the control unit further comprises an indicating module, if at least one of the inclined angle of the cold chain transportation device and the acceleration of the cold chain transportation device exceeds the inclined threshold and the acceleration threshold, respectively, the processor triggers a control signal to enable the indicating module.

4. The cold chain transportation device as claimed in claim 3, wherein the control unit further comprises a power supply and a communication module, the working states comprise a remaining capacity of the power supply, when the remaining capacity of the power supply is less than a first remaining capacity threshold, the processor enables the indicating module, when the remaining capacity of the power supply is less than a second remaining capacity threshold, the processor turns off the communication module and enables the indicating module.

5. The cold chain transportation device as claimed in claim 4, wherein the cover comprises an outer shell and a plate, the plate is received in the outer shell and defines a first receiving groove and a second receiving groove, the power supply is received in the first receiving groove, the control unit is received in the second receiving groove.

6. The cold chain transportation device as claimed in claim 1, wherein the control unit further comprises an input module, the working states further comprise working modes of the detection system, the working modes include a non flight mode, a flight delay mode, and a flight mode, and the non flight mode, the flight delay mode, and the flight mode are set or mutually switched by the input module.

7. The cold chain transportation device as claimed in claim 6, wherein the control unit further comprises a display, a flight mode icon and a wireless communication icon are shown on display for indicating the working modes of the detection system, when the detection system works at the non flight mode, the wireless communication icon is highlighted and shown on the display, when the detection system works at the flight delay mode, the flight mode icon is highlighted and shown on the display.

8. The cold chain transportation device as claimed in claim 1, wherein the control unit further comprises a radio frequency identification (RFID) tag, the RFID tag allocates an identification number to the cold chain transportation device.

9. The cold chain transportation device as claimed in claim 1, wherein the detection unit comprises two magnetic switches and two magnets, the two magnets are received in the body, and the two magnetic switches are positioned at the cover and are respectively in close proximity to the two magnets.

10. A detection system employed in a cold chain transportation device and in communication with an electronic terminal, the detection system comprising:

a temperature sensor sensing a temperature of the cold chain transportation device;

a detection unit detecting opened/closed states of the cold chain transportation device; and a control unit determining motion states and working states of the cold chain transportation device and transmitting the temperature, the opened/closed states, the motion states, and the working states of the cold chain transportation device to the electronic terminal, the motion states comprising an inclined angle and an acceleration of the cold chain transportation device.

11. The detection system as claimed in claim 10, wherein the control unit comprises a processor and a gravity sensor (G-sensor), the inclined angle and the acceleration of the cold chain transportation device is detected by the G-sensor, the processor compares the inclined angle and the acceleration with an inclined threshold and an acceleration threshold, respectively.

12. The detection system as claimed in claim 11, wherein the control unit further comprises an indicating module, if the inclined angle of the cold chain transportation device exceeds the inclined threshold or the acceleration of the cold chain transportation device exceeds the acceleration threshold, the processor triggers a control signal to enable the indicating module.

13. The detection system as claimed in claim 12, wherein the control unit further comprises a power supply and a communication module, the working states comprise a remaining capacity of the power supply, when the remaining capacity of the power supply is less than a first remaining capacity threshold, the processor enables the indicating module, when the remaining capacity of the power supply is less than a second remaining capacity threshold, the processor turns off the communication module and enables the indicating module.

14. The detection system as claimed in claim 10, wherein the control unit further comprises an input module, the working states further comprise working modes of the detection system, the working modes comprise a non flight mode, a flight delay mode, and a flight mode, and the non flight mode, the flight delay mode, and the flight mode are set or mutually switched by the input module.

15. The detection system as claimed in claim 14, wherein the control unit further comprises a display, a flight mode icon and a wireless communication icon are shown on display for indicating the working modes of the detection system, when the detection system works at the non flight mode, the wireless communication icon is highlighted and shown on the display, when the detection system works at the flight delay mode, the flight mode icon is highlighted and shown on the display.

16. The detection system as claimed in claim 10, wherein the control unit further comprises a radio frequency identification (RFID) tag, the RFID tag allocates an identification number to the cold chain transportation device.

* * * * *